United States Patent [19]

Marshall et al.

[11] Patent Number: 4,638,638

[45] Date of Patent: Jan. 27, 1987

[54] REFRIGERATION METHOD AND APPARATUS

[75] Inventors: John Marshall, Ascot; John D. Oakey, London, both of England

[73] Assignee: The BOC Group, PLC, Windlesham, England

[21] Appl. No.: 758,000

[22] Filed: Jul. 23, 1985

[30] Foreign Application Priority Data

Jul. 24, 1984 [GB] United Kingdom ..... 8418841

[51] Int. Cl.[4] ..... F25J 1/00

[52] U.S. Cl. ..... 62/9; 62/38; 62/514 R

[58] Field of Search ..... 62/9, 36, 38, 39, 514 R

[56] References Cited

U.S. PATENT DOCUMENTS 3,092,976 6/1963 Hashemi-Tafreshi ..... 62/9
4,094,655 6/1978 Krieger ..... 62/9

FOREIGN PATENT DOCUMENTS 2011058 7/1979 United Kingdom .

OTHER PUBLICATIONS

Springmann, H.; "The Liquefraction of Oxygen, Nitrogen and Argon"; *Linde Reports on Science and Technology;* 1978.

*Primary Examiner*—Ronald C. Capossela
*Attorney, Agent, or Firm*—Larry R. Cassett; Chris P. Konkol

[57] ABSTRACT

A method of liquefying a permanent gas stream includes the step of reducing the temperature of the permanent gas stream at elevated pressure to below its critical temperature. The reduction in temperature is effected at least in part by countercurrent heat exchange with work expanded working fluid, at least some of which is at a temperature below the critical temperature of the permanent gas when it is brought into heat exchange relationship with the permanent gas stream. The permanent gas stream after being cooled to below its critical temperature is then subjected to at least three successive isenthalpic expansions. Resulting flash gas is separated from the resulting liquid. At least some of the flash gas is heat exchanged with the permanent gas stream at elevated pressure.

10 Claims, 6 Drawing Figures

REFRIGERATION METHOD AND APPARATUS

BACKGROUND OF THE INVENTION

This invention relates to a refrigeration method and apparatus and is particularly concerned with the liquefaction of a permanent gas, for example nitrogen or methane.

A permanent gas has the property of not being able to be liquefied solely by increasing the pressure of the gas. It is necessary to cool the gas (at pressure) so as to reach a temperature at which the gas can exist in equilibrium with its liquid state.

Conventional processes for liquefying a permanent gas or for cooling it to or below the critical point typically require the gas to be compressed (unless it is already available at a suitably elevated pressure, generally a pressure above 30 atmospheres) and heat exchanged in one or more heat exchangers against at least one relatively low pressure stream of working fluid. At least some of the working fluid is provided at a temperature below the critical temperature of the permanent gas. At least part of each stream of working fluid is typically formed by compressing the working fluid, cooling it in the aforesaid heat exchanger or heat exchangers, and then expanding it with the performance of external work ("work expansion"). The working fluid may itself be taken from the high pressure stream of permanent gas, or the permanent gas may be kept separate from the working fluid, which may nonetheless have the same composition as the permanent gas.

Typically, the liquefied permanent gas is stored or used at a pressure substantially lower than that at which it is taken for isobaric cooling to below its critical temperature. Accordingly, after completing such isobaric cooling, the permanent gas at below its critical temperature is passed through an expansion or throttling valve whereby the pressure to which it is subjected is substantially reduced, and a substantial volume of so called "flash gas" is produced. The expansion is substantially isenthalpic and results in a reduction in the temperature of the liquid being effected. Generally, one or two such expansions are performed to produce flash gas and liquefied permanent gas in equilibrium with its vapour at a storage pressure. Generally, the thermodynamic efficiency of commercial processes for liquefying permanent gas is relatively low and there is ample scope for improving such efficiency. Considerable emphasis in the art has been placed on improving the total efficiency of the process by improving the efficiency of heat exchange in the process. Thus, prior proposals in the art have centred around minimising the temperature difference between the permanent gas stream and the working fluid stream or streams being heat exchanged therewith.

We have now found a way of increasing the efficiency of the isenthalpic expansion stage of the liquefaction process. This increase of efficiency is not merely of intrinsic value: it also enables more favourable conditions to be set for the work expansion (or at least the lower or lowest temperature work expansion) of working fluid and therefore makes it possible to achieve an improvement in the overall thermodynamic efficiency of the liquefaction greater than that achievable for the isenthalpic expansion alone.

DETAILED DESCRIPTION OF THE INVENTION

According to the present invention, there is provided a method of liquefying a permanent gas stream, comprising the steps of reducing the temperature of the permanent gas stream at elevated pressure to below its critical temperature, the reduction in temperature being effected at least in part by countercurrent heat exchange with work expanded working fluid at least some of such working fluid being at a temperature below the critical temperature of said permanent gas when it is brought into heat exchange relationship with the permanent gas stream; subjecting the permanent gas stream below said critical temperature to at least three successive isenthalpic expansions; separating resultant flash gas from the resultant liquid after each isenthalpic expansion, liquid from each isenthalpic expansion, save the last, being the fluid that is expanded in the immediately succeeding isenthalpic expansion; and heat exchanging at least some of the said flash gas with said permanent gas stream.

The invention also provides apparatus for liquefying a permanent gas stream, comprising heat exchange aeans having a passage therethrough for the permanent gas stream at elevated pressure in heat exchange relationship with at least one passage for work expanded working fluid and at least one passage for flash gas, at least one work expansion means for providing at least some of the work-expanded working fluid at a temperature below the critical temperature of the permanent gas stream, whereby the temperature of the permanent gas stream is able to be cooled to below its critical temperature, at least three expansion valves in series for performing at least three successive isenthalpic expansions of said permanent gas stream, the downstream side of each valve communicating with a separator adapted to separate resultant flash gas from resultant liquefied gas and each separator save the most downstream having an outlet for liquefied gas that communicates with the upstream side of the next downstream one of the expansion valves.

It is inherently more efficient thermodynamically to perform three or more successive isenthalpic expansions (i.e. isenthalpic pressure reductions) between a given starting and a given final temperature than to span the identical temperature range with just one or two isenthalpic expansions. The reason why this greater efficiency is attainable is explained below by way of example with reference to FIG. 2 of the accompanying drawings.

Typically, after passing out of heat exchange relationship with the permanent gas stream, the flash gas is recompressed with incoming permanent gas for liquefaction.

Typically, said work expanded working fluid is formed and said countercurrent heat exchange is performed in at least one working fluid cycle in which the working fluid is compressed, is cooled (with the permanent gas stream), is work expanded in an expansion turbine (or other work expansion means), is warmed by the countercurrent heat exchange with the permanent gas stream, the stream thereby being cooled, and is returned for recompression. If desired, two or more work expansion stages may be emplqyed in a working fluid cycle. Thus, the working fluid intermediate the cooling and warming stages may be work-expanded to an intermediate pressure, partially reheated and work expanded to a lower pressure but typically the same temperature as produced by the first work expansion.

We prefer to employ at least two working fluid cycles, the working fluid in one cycle being brought into countercurrent heat exchange relationship with the permanent gas stream at a lower temperature than the working fluid in the other cycle or cycles.

In such methods, we believe that we can use the three or more isenthalpic expansions to effect temperature reduction of the working fluid over a wider temperature range than is conventional in comparable known liquefaction methods. By so doing, the refrigeration demand placed upon the lowest temperature working fluid cycle is able to be reduced, thereby enabling a relatively high expansion turbine outlet temperature and hence outlet pressure to be employed in this cycle. In at least the lowest temperature working fluid cycle, we strongly prefer the working fluid to be at a pressure of at least 10 atmospheres and to be generally in the range 12 to 20 atmospheres once the work expansion is completed (i.e. the expansion turbine has an outlet pressure of at least 10 atmospheres and generally from 12 to 20 atmospheres). Such outlet pressures are much higher than those conventionally employed in turbine expansion cycles. When employing such higher pressures, the specific heat of the work expanded working fluid is substantially higher, thereby making it possible to increase the thermodynamic efficiency of at least the lowest temperature working fluid cycle and hence its specific power consumption. Preferably, if the outlet pressure of the expansion turbine is in the range 12 to 20 atmospheres once the work expansion is completed, the working fluid is at its saturation temperature or at a temperature up to 2K higher than the saturation temperature. At and close to the saturation temperature, the specific heat of the working fluid increases relatively rapidly with decreasing temperature.

Accordingly our preference for having the working fluid work expanded to its saturation temperature (or one close thereto) makes it possible to enhance the benefit in terms of increased thermodynamic efficiency to be gained by employing an expansion turbine outlet pressure of at least 10 atmospheres. Indeed, the working fluid, once its work expansion is complete, may advantageously be fully saturated or wet. In the event that two or more expansion turbines are employed in the working fluid cycle, the lowest pressure turbine has the outlet temperature at or up to 2K higher than the saturation temperature of the working fluid.

We prefer to bring at least some and preferably all of the said flash gas into heat exchange relationship with said permanent gas stream at a permanent gas stream temperature lower than that at which work-expanded working fluid is brought into heat exchange relationship with said permanent gas stream. In one typical example, we believe we can reduce the temperature of the permanent gas stream by approximately 3K and this means that the said lower temperature can be 3K higher than it would otherwise need to be, thereby increasing the scope for raising the outlet pressure of the expansion turbine in the lowest temperature working fluid cycle to a relatively high pressure (which may be a saturation pressure).

We prefer to utilise this increase in efficiency by taking the permanent gas stream for isenthalpic expansion at a higher temperature than has hitherto been the practice in the art.

In accordance with the present invention, if the permanent gas stream consists of nitrogen, we prefer to reduce the temperature of the nitrogen to 107 to 117K (and typically 110K) before subjecting it to the aforesaid successive isenthalpic expansions. The temperature of 110K may be used over a wide range of permanent gas stream pressures.

If the permanent gas is, say, a nitrogen stream produced by a cryogenic air separation plant generating at least several hundred tonnes of oxygen per day, flash gas is typically produced at a rate of about half that at which product liquid nitrogen is formed and the nitrogen stream may be taken for said expansions at the said temperature of 110K. In those smaller plants where centrifugal compressors are used and at expansion turbine outlet temperatures approaching the critical temperature of the working fluid a relatively higher rate of formation of flash gas (e.g. up to 100% of the rate at which product liquid is formed) is typically preferred to increase the recycle gas volume and maintain the recycle compressor efficiency. As the outlet temperature of the turbine approaches the critical temperature, it will not in general be possible to maintain the outlet temperature of the expansion turbine within 2K of the saturation temperature unless an exceptionally high outlet pressure is also employed (i.e. over 20 atmospheres in the example of nitrogen as the working fluid).

Typically, the permanent gas stream is also cooled by heat exchange with at least one stream of refrigerant. The said stream of refrigerant is brought into countercurrent heat exchange relationship with the permanent gas stream at a temperature or temperatures above those at which work expanded working fluid is brought with the permanent gas stream.

In the example of the liquefaction of nitrogen, we prefer to provide cooling of the permanent gas stream from ambient temperature down to about 210K by means of the said streams of refrigerant. The advantage of so doing is that it reduces the refrigeration load on the higher temperature work expansion stage or stages and thus enables it or them to be operated more efficiently than would otherwise be possible.

The refrigerant is typically a "Freon" or other such non-permanent gas employed in refrigeration. The working fluid is typically a permanent gas and is for convenience generally taken from the gas to be liquefied and may also be remerged therewith for compression.

In general, it is desirable to maintain a close conformity between the temperature-enthalpy profile of the permanent gas stream and that of the working fluid, particularly in the temperature range above the critical temperature where the rate of change in the specific heat of the permanent gas is at a maximum, (e.g. between about 135 and 180K for nitrogen at 50 atmospheres).

The precise temperatures at which work expanded working fluid is brought into countercurrent heat exchange relationship with the permanent gas stream and the number of such working fluid cycles that are employed may be selected so as to provide such conformity.

In liquefying permanent gas supplied at pressure of 45 atmospheres or less we prefer to employ three working fluid cylces for this purpose. By employing three cycles, we are able to keep the refrigeration load on the lowest temperature cycle to a level compatible with the operation of the expansion turbine in that cycle with an outlet pressure of at least 12 atmospheres. In the example of the liquefaction of nitrogen at 45 atmospheres, we prefer to employ a lowest temperature or "cold" working fluid cycle with an expansion turbine outlet pressure of 16 atmospheres and outlet temperature of about 112K, an intermediate working fluid cycle with two expansion turbines both having outlet temperature of about 136K and a "warm" working fluid cycle with an expansion turbine outlet temperature of about 160K. The higher the permanent gas pressure, the less sinuous is its temperature-enthalpy profile and therefore the more readily is a close conformity between its temperature-enthalpy. profile and that of the working fluid able to be maintained. Accordingly, at permanent gas pressures of above 45 atmospheres, we prefer to employ just two working fluid cycles. For example for nitrogen at 50 atmospheres, we prefer to employ a "cold" working fluid cycle having an expansion turbine outlet pressure of 14 atmospheres, and outlet temperature of 110–112K and a "warm" working fluid cycle having an expansion turbine outlet temperature of about 150K.

Unless it is available at a suitably elevated pressure, the permanent gas is preferably raised to an elevated pressure in a suitable compressor or bank of compressors. In one example, the pressure of the permanent gas is raised in several steps in a multistage compressor to an intermediate pressure and is then raised to a final chosen pressure by means of at least one rotary boost compressor whose rotor is mounted on the same shaft on the rotor of an expansion turbine employed in the work expansion of the working fluid. Typically, each different pressure flash gas stream is returned to a different stage of the multistage compressor.

In order to keep down the number of separate passes through the heat exchanger means it is preferred that the working fluid cycles share a common path through the heat exchanger back to the compressor.

The invention is not limited to the liquefaction of nitrogen and methane. Other gases such as carbon monoxide and oxygen may also be liquefied thereby.

The invention will now be described by way of example with reference to the accompanying drawings, in which;

BRIEF DESCRIPTION OF THE DRAWINGS

Referring to FIG. 1 of the accompanying drawings, a stream of liquid nitrogen 2 at a temperature of 113K and a pressure of 45 atmospheres passes through a heat exchanger 4 in which it is reduced in temperature to 110K. The stream then passes through an isenthalpic expansion or throttling valve 6, the pressure to which the stream is subject thereby being reduced to 8 atmospheres. The pressure reduction causes a considerable volume of gaseous nitrogen to flash from the fluid passing through the valve 6 leaving liquid nitrogen at a pressure of 8 atmospheres. The flash gas is then separated from the liquid nitrogen in a phase separator 10. The flash gas is returned through the heat exchanger 4 countercurrently to the incoming liquid nitrogen stream 2 to provide part of the cooling for said stream.

Figure 1:
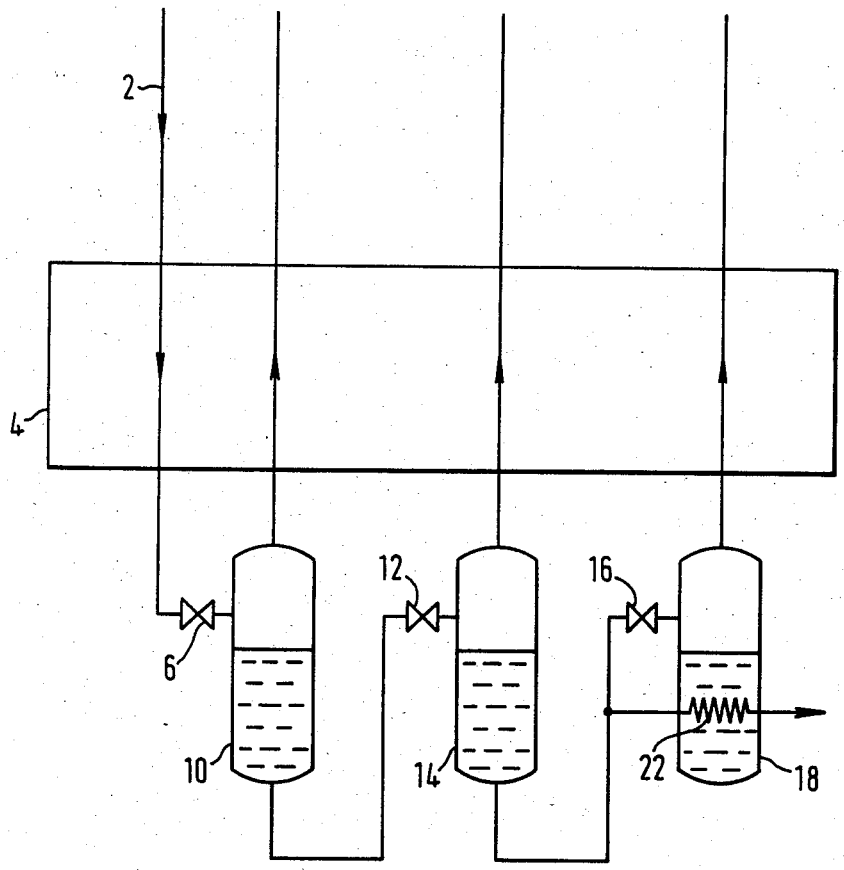
FIG. 1 is a schematic circuit diagram illustrating part of a plant for liquefying nitrogen in accordance with the invention.

Liquid nitrogen at a pressure of 8 atmospheres is taken from the separator 10 and passed through a second isenthalpic expansion or throttling valve 12, the pressure to which the liquid nitrogen is subject thereby being reduced to 3.1 atmospheres. The pressure reduction causes a further volume of gaseous nitrogen to flash from the liquid passing through the valve 12, leaving liquid nitrogen at a pressure of 3.1. atmospheres. The flash gas is then separated from the liquid nitrogen in a second phase separator 14. The flash gas is returned through the heat exchanger 4 in parallel passes to the 8 atmosphere flash gas stream and countercurrently to the incoming liquid nitrogen stream 2 to provide part of the cooling for said stream.

Liquid nitrogen is taken from the separator 14 and some of it is then passed through a third expansion or throttling valve 16, the pressure to which the liquid nitrogen is subject thereby being reduced to 1.3 atmospheres. The pressure reduction causes a yet further volume of gaseous nitrogen to flash from the liquid passing through the valve 16, leaving liquid nitrogen at a pressure of 1.3 atmospheres. The flash gas is then separated from the liquid nitrogen in a third phase separator 18. The flash gas is returned through the heat exchanger 4 in parallel passes to the 8 atmosphere and 3.1 atmosphere flash gas streams and countercurrently to the incoming liquid nitrogen stream 2 to provide part of the cooling for said stream.

The remaining liquid nitrogen from the separator 62 is passed to storage from the second phase separator 14. This liquid nitrogen is undercooled by passing it through a heat-exchange coil 22 immersed in the third phase separator 18 and is then passed to the top of the storage vessel (not shown). The liquid nitrogen in the third separator is thus caused to boil and the resulting vapour joins the flash gas and is returned through the heat exchanger countercurrently to the permanent gas stream 4.

Figure 2:
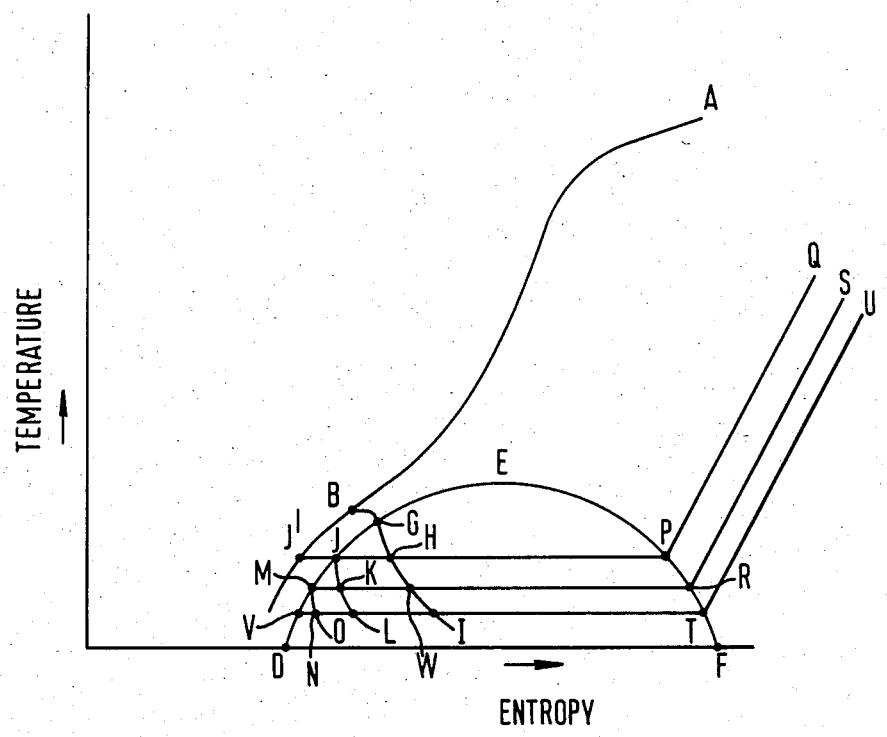
FIG. 2 is a schematic graph of temperature against entropy for nitrogen.

Referring now to FIG. 2, the line AB is an isobar along which nitrogen is cooled during a process for its liquefaction. The point B represents the temperature at which the liquid nitrogen leaves the heat exchanger 36 (see FIG. 3) (i.e. 110K). The curve DEF defines an 'envelope' in which the nitrogen exists as a "biphase" of liquid and gas. Lines BGHI, JKL and MNO are lines of constant enthalpy. Lines PQ, RS and TU are isobars for gaseous nitrogen.

Considering now the first isenthalpic expansion through valve 6 in FIG. 1, the nitrogen follows the line of constant enthalpy BGHI until it reaches point H within the envelope DEF. The nitrogen exists there as a biphase of gas and liquid. The phase separator 10 separates the gas from the liquid; thus as a result of this separation, liquid nitrogen is obtained at point J (and flash gas at point P). The second isenthalpic expansion takes the nitrogen along the line JKL of constant enthalpy until it reaches point K. The second phase separation produces liquid at point M (and flash gas at point R). The third isenthalpic expansion takes the nitrogen along the line MNO until point N is reached. The third phase separation thus produces liquid at point V (and flash gas at point T). The liquid in the third separator is evaporated by the liquid from the second separator that is undercooled. The undercooled liquid is passed to storage at a pressure equal to that at point M and at a temperature between that at point M and that at point V and close to the latter temperature.

Suppose now that liquid at point V is produced as a result of only one isenthalpic expansion. This will involve the nitrogen following the path BGHI until point W is reached. The total entropy increase involved in this step is greater than the sum of the entropy increases involved in following the paths GH, JK and MN. This is because the lines GH, JK and MN are all relatively steep whereas the path HI is less steep; (indeed the (negative) slope of each line of constant enthalpy decreases with decreasing temperature). Accordingly, more irreversible work is involved in performing one isenthalpic expansion than in performing three successive isenthalpic expansions and hence the latter process (which is in accordance with our invention) is more thermodynamically efficient than the former process. Moreover, use of at least three isenthalpic expansions reduces the amount of working fluid on which irreversible work is performed in each isenthalpic expansion after the first.

It can also be appreciated that further increases in efficiency can be gained if the point V is reached via 4 or 5 or more successive isenthalpic expansions. In practice, however, the use of more than five isenthalpic expansions gives such diminished extra benefit that it is rarely justified.

It will also be appreciated that the first isenthalpic expansion (BGH) is relatively less efficient than the second and third isenthalpic expansions, as the step BG involves a relatively large increase in entropy. It will be seen that the isobar AB at temperatures below that of point B converges towards the envelope DEF. Accordingly, it might be thought more advantageous to cool isobarically down to a temperature corresponding to point J and then perform less than three successive isenthalpic expansions. However, such a practice would be disadvantageous as it results in an overriding loss of thermodynamic efficiency in the work expansion of working fluid necessary to cool the nitrogen down to the temperature at which it is taken for isenthalpic expansion and moreover the increase in entropy J'J is greater than BG along the lines of contstant enthalpy.

Referring again to FIG. 1, various methods are available for producing a stream 2 of nitrogen at a temperature of about 113K and a pressure of 45 atmospheres. The plant illustrated in FIG. 3 of the accompanying drawings includes means for producing such a stream of nitrogen.

Figure 3:
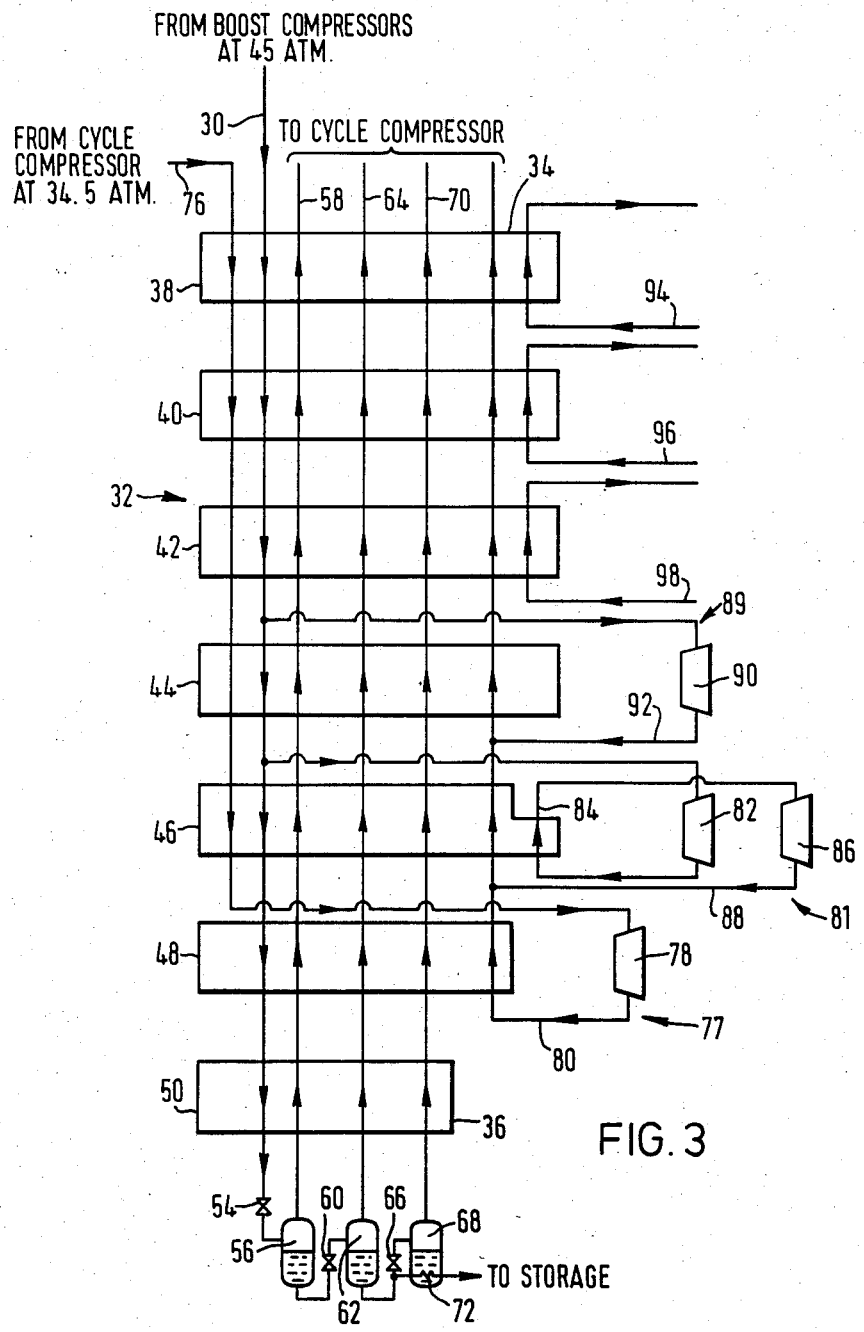
FIG. 3 is a schematic circuit diagram illustrating a plant for liquefying nitrogen in accordance with the invention.

Referring now to FIG. 3, a main nitrogen stream 30 at ambient temperature (say 300K) and a pressure (say 45 atmopsheres) above the critical pressure is passed through a heat exchange means 32 having a warm end 34 and a cold end 36 and comprising a succession of heat exchangers 38, 40, 42, 44, 46, 48 and 50 each operating over a progressively lower temperature range than the heat exchanger immediately upstream of it (in respect to the direction of flow of the stream 30). On leaving the heat exchanger 50 the stream 32 has a temperature of about 110K. It is then isenthalpically expanded through throttling valve 54 to produce liquid nitrogen at a pressure of 8 atmospheres and a volume of flash gas at 8 atmospheres. The flash gas steam 58 is taken from the separator 56 and is returned from the cold end 36 to the warm end 34 of the heat exchanger means 32 in countercurrent heat exchange relationship with the stream 30.

The liquid nitrogen from the phase separator 56 is isenthalpically expanded through a second throttling valve 60 to produce liquid nitrogen and flash gas at a pressure of 3.1 atmospheres. The liquid nitrogen is separated from the flash gas in a second phase separator 62. A flash gas stream 64 is taken from the separator 62 and is returned from the cold end 36 to the warm end 34 of the heat exchange means 32 in countercurrent heat exchange relationship with the stream 30. Some of the liquid collecting in the phase separator 62 is isenthalpically expanded through a third throttling valve 66 to produce liquid nitrogen and flash gas at a pressure of 1.3 atmospheres. The liquid nitrogen is separated from the flash gas in a third pase separator 68. A flash gas stream 70 is taken from the third phase separator 68 and is returned from the cold end 36 to the warm end 34 of the heat exchange means 32 in countercurrent heat exchange relationship with the stream 30. Liquid is withdrawn from the phase separator 62 and passed to storage after being undercooled in a coil 72 immersed in the liquid nitrogen in the third phase separator 68. The liquid nitrogen in the phase separator 68 is thus caused to boil and the resulting vapour joins the flash gas stream 70.

The flash gas streams 58, 64 and 70 provide all the cooling for the heat exchanger 52 and are effective to reduce the temperature of the nitrogen stream 30 from 113K to 110K. Typically, flash gas is produced at 50% of the rate at which liquid nitrogen is passed to storage. The pressures at which flash gas is produced are determined by the pressures in the compressor stages to which the flash gas is returned from the warm end 34 of the heat exchange means 32.

A stream 76 of nitrogen working fluid in a first working fluid cycle 77 at a pressure of 34.5 atmospheres and at a temperature of about 300K is passed through the heat exchange means 32 cocurrently with the stream 30 and flows successively through heat exchangers 38,40, 42, 44 and 46, and leaves the heat exchanger 46 at a temperature of 138K. This stream is then work-expanded in "cold" expansion turbine 78 to a pressure of 16 atmospheres. The resulting working fluid leaves the turbine 78 as a stream 80 at a temperature of 112K and is passed through the heat exchanger 48 countercurrently to the stream 30 thus being warmed and meeting the refrigeration requirements of the heat exchanger 48 and then flows successively through the heat exchangers 46, 44, 42, 40 and 38.

In a second working fluid cycle 81, a portion of the stream 30 is withdrawn therefrom as working fluid at a location intermediate the cold end of the heat exchanger 44 and the warm end of the heat exchanger 46 at a temperature of 163K and is passed into a first intermediate expansion turbine 82 and is work expanded therein, leaving the turbine 82 as stream 84 at a temperature of 136K and a pressure of 23 atmospheres. The stream 84 is passed through the heat exchanger 46 countercurrently to the stream 30 thus being reheated and is withdrawn from the heat exchanger at an intermediate location at a temperature of 150K. It is then passed into a second intermediate expansion turbine 86 and is work expanded therein. The nitrogen leaves the turbine 86 as stream 88 at a pressure of 16 atmospheres and a temperature of 136K and is then united with the stream 80 at a region intermediate the cold end of the heat exchanger 46 and the warm end of the heat exchanger 48, and is thus able to help meet the refrigeration requirements of the heat exchanger 46.

In a third working fluid cycle 89, a further portion of the stream 30 is withdrawn therefrom as working fluid at a region intermediate the cold end of the heat exchanger 42 and the warm end the heat exchanger 44 and flows at a temperature of 210K into a "warm" expansion turbine 90 in which it is work-expanded. The nitrogen leaves the expansion turbine as stream 92 at a pressure of about 16. atmospheres and a temperature of 160.5K. The stream 92 is then united with the stream 80 at a location intermediate the cold end of the heat exchanger 44 and the warm end of the heat exchanger 46. The stream 92 thus helps to meet the refrigeration requirements of the heat exchanger 42.

Conventional Freon refrigerators 94, 96 and 98 are employed to refrigerate the heat exchangers 38, 40 and 42 respectively. By this means the temperature of the stream 30 is able to be reduced from 300K at the warm end of the heat exchange means 32 to 210K at the cold end of the heat exchanger 42.

The compressor system employed in the plant shown in FIG. 3 is for purposes of enhancing the general clarity of FIG. 3 not illustrated therein. It includes, however a multi-stage compressor having a first stage which operates with an inlet pressure of 1 atmosphere and a final stage which has an outlet pressure of 34.5 atmospheres. Nitrogen at 1 atmosphere is fed to the inlet of the first stage together with the flash gas stream 70. During succeeding stages it is united with the flash gas streams 64 and 58 after they have left the warm end 34 of the heat exchange means 32. It is also united with the stream 80 of returning work expanded working fluid in a further stage of the compressor. Each of the streams 58, 64, 70 and 80 is supplied to a different stage of the compressor from the others.

A part of the gas leaving the multistage compressor is taken to form the stream 76. The remainder is further compressed by means of four boost compressors, each driven by a respective one of the expansion turbines, to a pressure of 45 atmospheres and is then used to form the main nitrogen stream 30.

Each stage of the multistage compressor and each boost compressor typically has its own water cooler associated therewith to remove the heat of compression from the compressed gas.

Figure 4:
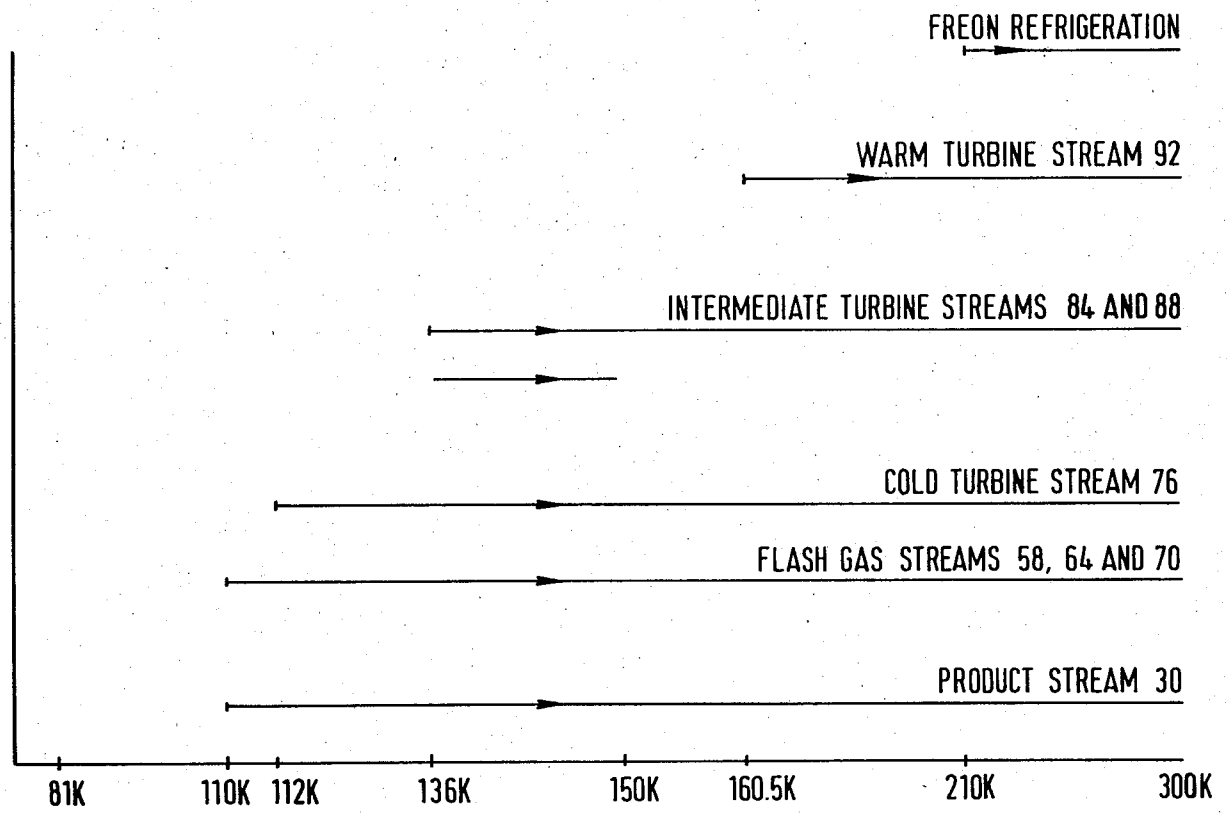
FIG. 4 is a diagrammatic representation of the plant shown in FIG. 3.
Figure 5:
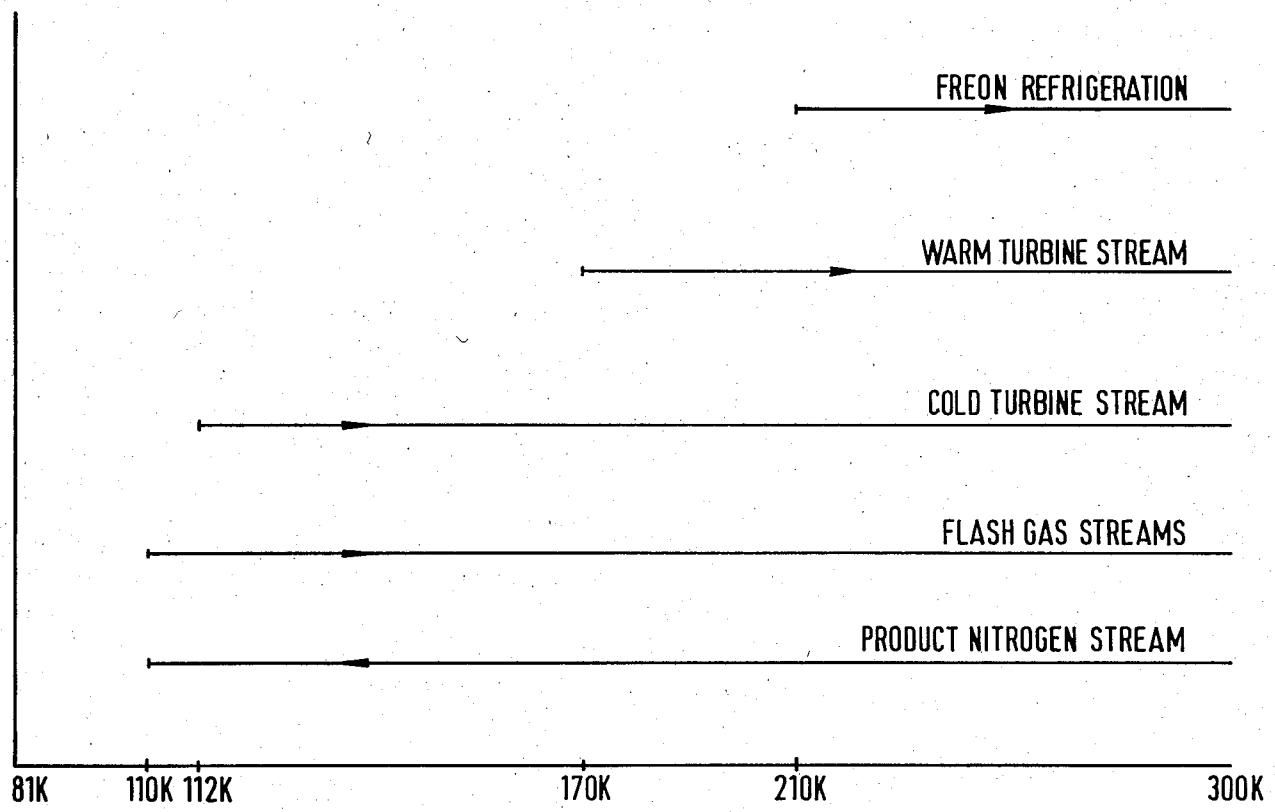
FIG. 5 is a diagrammatic representation of an alternative plant for liquefying nitrogen.

The plant shown in FIG. 3 is represented in a schematic manner in FIG. 4. An alternative plant suitable for liquefying a nitrogen stream at a pressure of more than 45 atmospheres (e.g. 50 atmospheres) is similarly represented in FIG. 5. The main difference between the plant represented in FIG. 5 and that represented in FIG. 4 is that whereas the former employs four work-expansion turbines the latter employs only two such turbines. One turbine (a "cold turbine") takes compressed nitrogen at 150K and reduces its temperature to about 110K by work expansion to about 14 atmospheres in the example of nitrogen at 50 atmospheres), whereas the other turbine (a "warm" turbine) takes compressed nitrogen at 210K and reduces its temperature to about 150K. Although, therefore, only two work expanded streams of working fluid are employed in the cooling of the product nitrogen stream to below its critical temperature, the relatively higher pressure of this stream renders its temperature enthalpy profile (not shown) less sinuous and thereby makes it possible to maintain the temperature enthalpy profiles of the return stream in reasonable conformity with the temperature enthalpy profile of the product nitrogen stream.

Figure 6:
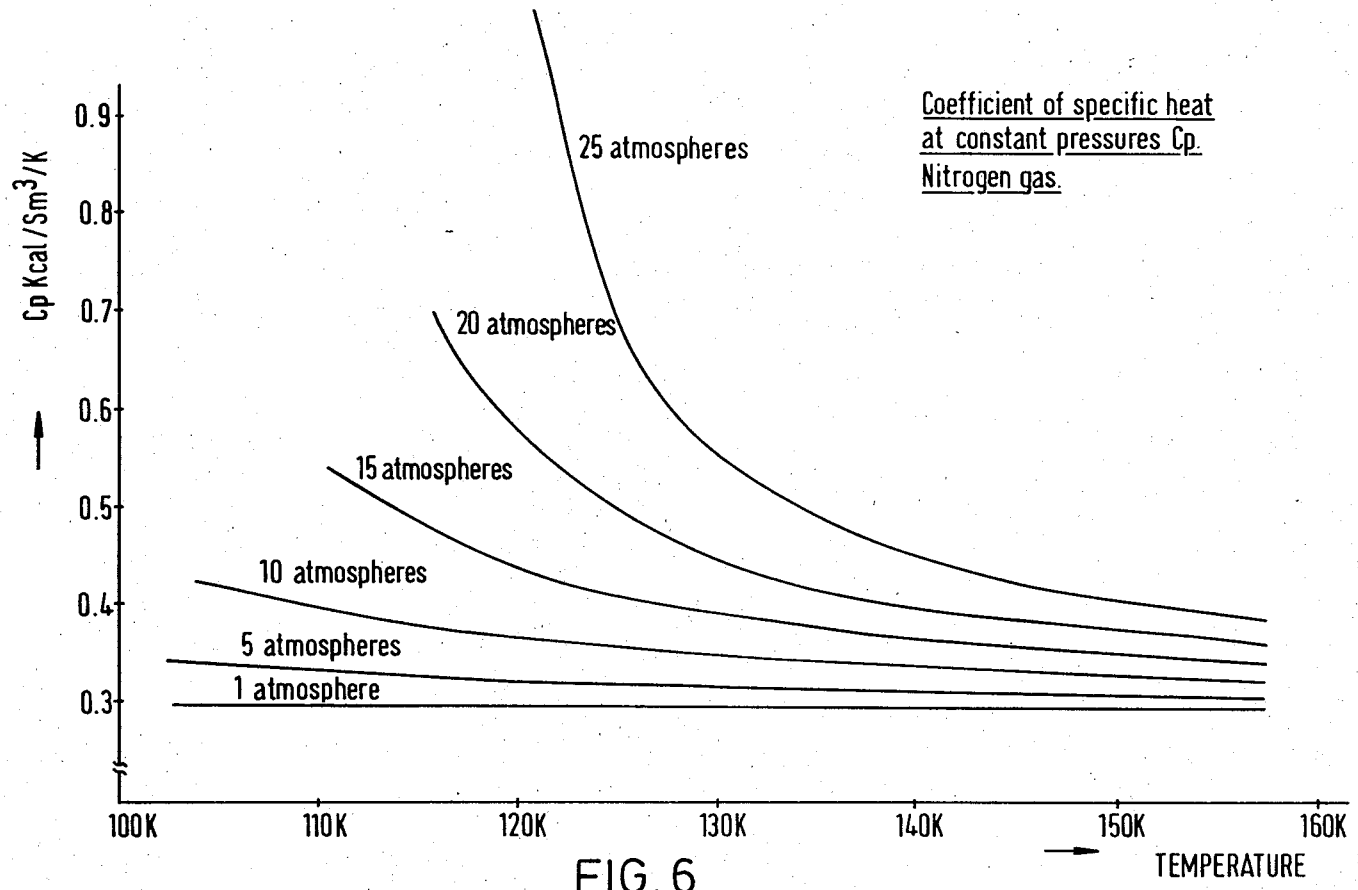
FIG. 6 is a graph showing specific heat-temperature curves for nitrogen at different pressures.

Referring again to FIG. 3 of the accompanying drawings, as the stream 80 of work-expanded working fluid (nitrogen) passes through the heat exchange means 32 towards its warm end 34, so it is progressively heated. Assuming that such passage is substantially isobaric, this means that the nitrogen working fluid will follow an isobar such as one of those illustrated in FIG. 6 of the accompanying drawings. FIG. 6 illustrates a family of curves showing the variation of the specific heat of nitrogen with temperature at various pressures ranging from 1 atmosphere to 25 atmospheres. The left hand end (as shown) of each isobar is defined by the saturation temperature of gaseous nitrogen. It can be seen that the higher the pressure of the isobar (effectively the warming curve) so the greater is the specific heat of nitrogen at any given temperature lying on the isobar and hence the greater is its refrigeration capacity at that temperature. The relative difference between the specific heat of nitrogen at a higher pressure and given temperature and the specific heat of nitrogen at a lower pressure and the same temperature increases with increasing higher pressure and this increase is particularly marked at pressures above 10 atmospheres.

We claim:

1. In a method liquefying a nitrogen gas stream, including the reduction of the temperature of the nitrogen gas stream at super-critical pressure to below its critical temperature in which the reduction in temperature is effected at least in part by countercurrent heat exchange with work expanded nitrogen working fluid, at least some of such working fluid being at a temperature below the critical temperature of nitrogen when it is brought into heat exchange relationship with the nitrogen gas stream; the improvement comprising withdrawing said super-critical pressure nitrogen gas stream at a temperature of 107 to 117K from heat exchange relationship with said work-expanded working fluid and subjecting the nitorgen gas stream to at least three successive isenthalpic expansions to below its critical pressure to produce a liquid and a flash gas; separating said flash gas from said liquid after each isenthalpic expansion, wherein liquid from each isenthalpic expansion, except the final insenthalpic expansion, is the fluid that is expanded in the immediately succeeding expansion, and heat exchanging at least some of the said flash gas with said super-critical pressure nitrogen gas stream.

2. A method as claimed in claim 1, wherein at least some of said flash gas is brought into heat exchange relationship with said permanent gas stream at a permanent gas stream temperature lower than that at which any work-expanded working fluid is brought into heat exchange relationship with said permanent gas.

3. A method as claimed in claim 1, in which the first isenthalpic expansion is performed on permanent gas at a temperature of 107 to 117K, the permanent gas being nitrogen.

4. A method as claimed in claim 1, in which said work expanded working fluid is formed and said countercurrent heat exchange is performed in at least one working fluid cycle in which the working fluid is compressed, is cooled together with the permament gas stream, is work expanded in at least one expansion turbine, is warmed by the countercurrent heat exchange with the permanent gas stream, the stream thereby being cooled, and is returned for recompression.

5. A method as claimed in claim 4, in which in a working fluid cycle producing working fluid at above said critical temperature the working fluid intermediate the cooling and warming stages may be work-expanded to an intermediate pressure, partially reheated and work expanded to a lower pressure.

6. A method as claimed in claim 4, in which at least two working fluid cycles are employed, the working fluid in one cycle being brought into heat exchange relationship with the permanent gas stream at a lower temperature than the working fluid in the other cycle.

7. A method as claimed in claims 4, in which in at least one working fluid cycle work-expanded working fluid is brought into heat exchange relationship with the permanent gas stream at a temperature above its critical temperature, and the permanent gas stream is also cooled by heat exchange with at least one stream of refrigerant, the or each stream of refrigerant, being brought into heat exchange relationship with the permanent gas stream at a temperature or temperatures above those at which work expanded working fluid is brought into heat exchange relationship therewith, said at least one stream of refrigerant providing refrigeration for said permanent gas stream in the range of ambient temperature down to 210K.

8. A method as claimed in claim 1, in which the permanent gas is produced at said elevated pressure by compressing it in a multi-stage compressor, each flash gas stream being passed to a different stage of the compressor from those to which the other flash gas streams are passed.

9. A method as claimed in claim 1, in which the said elevated pressure is 45 atmospheres or less.

10. A method as claimed in claim 1, in which the said elevated pressure is greater than 45 atmospheres.

* * * * *